US012286974B2

(12) United States Patent
Schofield et al.

(10) Patent No.: US 12,286,974 B2
(45) Date of Patent: Apr. 29, 2025

(54) MULTI-STAGE TURBOMOLECULAR PUMP

(71) Applicant: Edwards Limited, Burgess Hill (GB)

(72) Inventors: Nigel Paul Schofield, Burgess Hill (GB); Stephen Dowdeswell, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 419 days.

(21) Appl. No.: 17/312,787

(22) PCT Filed: Dec. 11, 2019

(86) PCT No.: PCT/GB2019/053498
§ 371 (c)(1),
(2) Date: Jun. 10, 2021

(87) PCT Pub. No.: WO2020/120955
PCT Pub. Date: Jun. 18, 2020

(65) Prior Publication Data

US 2022/0049705 A1 Feb. 17, 2022

(30) Foreign Application Priority Data

Dec. 12, 2018 (GB) ..... 1820200

(51) Int. Cl.
*F04D 19/04* (2006.01)
*F04D 19/02* (2006.01)
(Continued)

(52) U.S. Cl.
CPC ..... *F04D 19/042* (2013.01); *F04D 19/02* (2013.01); *F04D 29/023* (2013.01);
(Continued)

(58) Field of Classification Search
CPC ..... F04D 19/042; F04D 19/02; F04D 29/263; F04D 29/266; F04D 29/329; F04D 29/584; F04D 19/044; F04D 19/046
See application file for complete search history.

(56) References Cited

U.S. PATENT DOCUMENTS 5,350,275 A * 9/1994 Ishimaru ..... F04D 29/023 415/217.1
5,848,873 A * 12/1998 Schofield ..... F04D 17/168 415/90
(Continued)

FOREIGN PATENT DOCUMENTS

CN 1429994 A 7/2003
CN 102597527 A 7/2012
(Continued)

OTHER PUBLICATIONS

Taiwanese Search Report dated Jun. 9, 2023 for corresponding Taiwanese application Serial No. TW108145614, 1 page.
(Continued)

*Primary Examiner* — Charles G Freay
*Assistant Examiner* — Lilya Pekarskaya

(57) ABSTRACT

A vacuum pump comprising a turbomolecular stage and a drag stage, the vacuum pump comprising a stator and a rotor. The rotor comprises a turbomolecular rotor and a drag rotor attached together. The turbomolecular rotor comprises a hub from which a plurality of blades extend, the hub comprising a mounting portion for mounting to a spindle of a motor and a hollow cylindrical portion, the hollow cylindrical portion extending from the mounting portion towards an outlet end of the turbomolecular stage. The drag rotor comprises a cylindrical skirt and an attachment part extending away from the cylindrical skirt, the attachment part extending within the hollow cylindrical portion of the hub of the turbomo-
(Continued)

lecular rotor and being attached thereto at a point that is closer to the mounting portion than to the outlet end of the turbomolecular rotor.

15 Claims, 1 Drawing Sheet

(51) Int. Cl.

| | |
|---|---|
| ***F04D 29/02*** | (2006.01) |
| ***F04D 29/26*** | (2006.01) |
| ***F04D 29/32*** | (2006.01) |
| ***F04D 29/58*** | (2006.01) |
| ***F04D 29/64*** | (2006.01) |

(52) U.S. Cl.
CPC ..... *F04D 29/263* (2013.01); *F04D 29/266* (2013.01); *F04D 29/329* (2013.01); *F04D 29/584* (2013.01); *F04D 29/644* (2013.01)

(56) References Cited

U.S. PATENT DOCUMENTS

| | | | | |
|---|---|---|---|---|
| 8,727,751 | B2 * | 5/2014 | Schofield | F04D 29/023 417/423.4 |
| 2002/0039533 | A1 | 4/2002 | Miyamoto | |
| 2003/0103847 | A1 * | 6/2003 | Nonaka | F04D 19/046 417/203 |
| 2008/0304985 | A1 * | 12/2008 | Onishi | F04D 27/008 417/423.4 |
| 2013/0045094 | A1 * | 2/2013 | Giors | F04D 29/023 415/200 |
| 2014/0212312 | A1 * | 7/2014 | Kozaki | F16C 32/0457 417/423.12 |
| 2014/0271237 | A1 * | 9/2014 | Kozaki | F04D 19/042 417/45 |
| 2015/0184666 | A1 * | 7/2015 | Tsubokawa | F04D 19/044 415/199.5 |
| 2015/0275914 | A1 | 10/2015 | Tsutsui | |
| 2020/0271118 | A1 * | 8/2020 | Schofield | F04D 17/168 |

FOREIGN PATENT DOCUMENTS

| | | | |
|---|---|---|---|
| CN | 103477082 | A | 12/2013 |
| CN | 104747466 | A | 7/2015 |
| CN | 104948475 | A | 9/2015 |
| EP | 1318308 | A2 | 6/2003 |
| EP | 1318309 | A2 | 6/2003 |
| EP | 1596068 | A2 | 11/2005 |
| JP | S6469797 | A | 3/1989 |
| JP | H10122179 | A | 5/1998 |
| JP | 2002285989 | A | 10/2002 |
| JP | 2003148375 | A | 5/2003 |
| WO | 2012172851 | A1 | 12/2012 |
| WO | 2015015902 | A1 | 2/2015 |

OTHER PUBLICATIONS

British Examination Report dated Jun. 6, 2019 and Search Report dated Jun. 5, 2019 for corresponding British Application No. GB1820200.2, 6 pages.

PCT Notification of Transmittal of the International Search Report and the Written Opinion of the International Searching Authority, or the Declaration dated Feb. 18, 2020 and PCT Search Report dated Feb. 18, 2020 for corresponding PCT Application No. PCT/GB2019/053498.

PCT Written Opinion dated Feb. 18, 2020 for corresponding PCT Application No. PCT/GB2019/053498.

Japanese Notification of Reason for Rejection dated Nov. 1, 2023 for corresponding Japanese application Serial No. 2021-533781, 6 pages.

Chinese Search Report dated Jan. 17, 2024 for corresponding Chinese application Serial No. 201980091911.0, 3 pages.

* cited by examiner

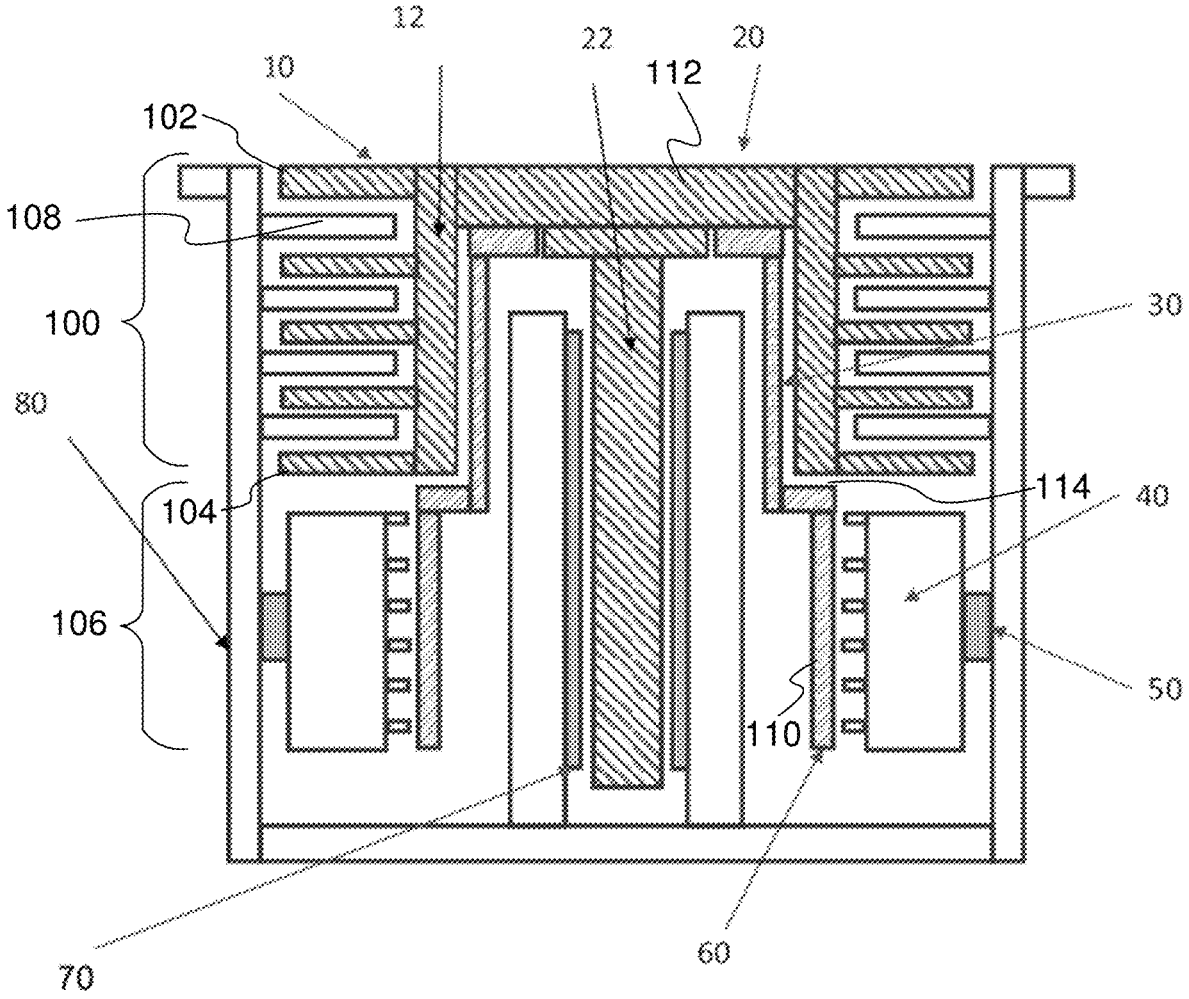
12
22
20
10
112
102
108
100
30
80
104
114
40
106
50
110
70
60

MULTI-STAGE TURBOMOLECULAR PUMP

CROSS-REFERENCE OF RELATED APPLICATION

This application is a Section 371 National Stage Application of International Application No. PCT/GB2019/053498, filed Dec. 11, 2019, and published as WO 2020/120955A1 on Jun. 18, 2020, the content of which is hereby incorporated by reference in its entirety and which claims priority of British Application No. 1820200.2, filed Dec. 12, 2018.

FIELD

The field of the invention relates to a vacuum pump with a turbomolecular stage and a drag stage.

BACKGROUND

Turbomolecular pumps are used to provide high vacuums, for example to provide the high vacuum required for semiconductor processing. They are expensive pumps designed for operation at high tip speeds. Their rotors are rotatably mounted on magnetic bearings to avoid the need for lubrication and to reduce vibrations, allowing clean room operation.

Turbomolecular pumps do not exhaust to atmosphere as they do not operate well at higher pressures and so generally these pumps have some form of backing pump stages to decrease the pressure at the exhaust of the turbo stages. These backing stages generally comprise a drag stage downstream of the turbomolecular stage or stages, integrated within the pump and mounted on the same shaft. The pump may also have additional backing pump(s) remote from and connected to the vacuum pump.

There is an increasing desire to operate turbomolecular pumps at higher temperatures. Semiconductor processes for example require pumps to be maintained at high temperatures to prevent process by-products from condensing. The temperature of a pump and the risk of condensates forming increases as the gases flow through the pumping system and pressures increase. Conventionally the rotors of turbomolecular pumps have been cast from Aluminium, with the drag and turbo stages being cast as one unit which provides a structurally robust rotor suitable for rotation at high speeds. Aluminium loses much of its strength above 130° C. and this limits turbo pump operation to temperatures at or below 130° C.

It would be desirable to provide a vacuum pump with a turbo and drag stage that is suitable for at least partial higher temperature operation.

The discussion above is merely provided for general background information and is not intended to be used as an aid in determining the scope of the claimed subject matter. The claimed subject matter is not limited to implementations that solve any or all disadvantages noted in the background.

SUMMARY

A first aspect provides a vacuum pump comprising a turbomolecular stage and a drag stage, said vacuum pump comprising a stator and a rotor, said rotor comprising a turbomolecular rotor and a drag rotor attached together; wherein said turbomolecular rotor comprises a hub from which a plurality of blades extend, said hub comprising a mounting portion for mounting to a spindle of a motor and a hollow cylindrical portion, said hollow cylindrical portion extending from said mounting portion towards an outlet end of said turbomolecular stage; and said drag rotor comprises a cylindrical skirt and an attachment part extending away from said cylindrical skirt, said attachment part extending within said hollow cylindrical portion of said hub of said turbomolecular rotor and being attached thereto at a point that is closer to said mounting portion than to said outlet end of said turbomolecular rotor.

The inventors of the present invention recognised that as the pressure increases through a turbomolecular pump so too does the risk of condensation of process gases. Thus, although there is a desire to operate pumps at increasingly higher temperatures to avoid condensation, this problem is more acute in the drag stage than it is in the turbo stage. Thus, one way to reduce condensation problems within such a vacuum pump might be to operate the two stages at different temperatures with some degree of thermal isolation between the two stages. Thus, the vacuum pump of embodiments is formed with a rotor made in two parts, the rotor of the drag stage being attached to the rotor of the turbo stage via an attachment part that extends longitudinally away from the skirt of the drag rotor and up into the inner hub of the turbo rotor. The attachment part can then be attached at a point that is remote from the outlet end of the turbo stage, such that the main thermal path between the hotter drag stage and the cooler turbo stage is via this attachment piece and through the point of attachment. This reduces the thermal conductivity between the two parts of the rotors and allows the two rotor parts to operate at different temperatures, such that the drag stage may be operated at a higher temperature than the turbo stage and condensation at the higher pressures within this stage is reduced.

Forming the rotors in two pieces also allows different materials to be selected for the two pieces so that materials with properties suitable for higher temperature operation can be selected for the drag stage rotor, while those more suitable for high tip speeds can be selected for the turbo rotor.

in some embodiments, said drag rotor is formed of a material that is resistant to higher temperatures than a material forming said turbomolecular rotor.

The drag stage of a turbomolecular pump operates at a higher pressure than the turbomolecular stage and it may be desirable to run it at a hotter temperature. Where the drag and turbomolecular rotor are formed of different parts attached together there is an opportunity to form them of different materials. Conventionally the drag and turbomolecular rotor has been cast as a single piece and as such has been constrained to be formed of the same material. Forming the rotor in two parts provides greater flexibility in the choice of materials allowing the drag rotor to be formed of a material that is more resistant to higher temperatures than the material forming the turbomolecular rotor.

Additionally and/or alternatively said drag rotor is formed of a material with a lower thermal conductivity than a material forming said turbomolecular rotor.

As the vacuum pump is configured to allow the drag stage to operate at a higher temperature than the turbo stage to reduce condensation in the drag stage, it is advantageous if the hotter drag rotor is thermally isolated, at least to some extent, from the turbomolecular rotor to reduce heat flowing from the drag rotor to the turbomolecular rotor. Thus, it may advantageous to make the drag rotor of a material with a low thermal conductivity, in some embodiments of a material with a lower thermal conductivity than the material forming the turbomolecular rotor.

Although the drag rotor may be formed of a number of materials, in some embodiments the drag rotor is formed of steel. Steel is a robust material that is resistant to high temperatures and is relatively easy to cast and is also relatively inexpensive.

In some embodiments, said drag rotor is formed of stainless steel.

Stainless steel may make a particularly effective material for forming the drag rotor having a particularly low thermal conductivity of about 18 W/mK and being resistant to corrosion and higher temperatures. In this regard, both steel and stainless steel can operate at temperatures up to 300° C.

In some embodiments, said turbomolecular rotor is formed of Aluminium.

Turbomolecular rotors are conventionally formed of Aluminium which has a low density, and is therefore suitable for the high tip speeds that turbomolecular rotors operate at, it is also robust and can be cast. Aluminium does however have a significantly higher thermal conductivity than steel or stainless steel having a thermal conductivity of 200 W/mK. Thus, although it is suitable for a turbomolecular rotor, being able to form the drag rotor of a different material that is both more thermally resistant and has a lower thermal conductivity allows the drag and turbo stages of the pump to operate at different temperatures, allowing the turbomolecular rotor to stay at a lower temperature suitable for Aluminium while the drag rotor operates at a higher temperature that reduces condensation. In this regard, if aluminium operates at a temperature in excess of 130° C. then it starts to lose its strength.

In some embodiments, said attachment part is attached to said mounting portion of said turbomolecular rotor.

Although the attachment part can be mounted to different parts of the turbomolecular rotor provided they are not too close to the outlet end thereby providing some thermal isolation, it may be particularly advantageous to attach the attachment part to the mounting portion of the turbo rotor this being remote from the outlet. This allows the attachment part to be particularly long and also provides a suitable surface for attaching the attachment part.

In this regard, said mounting portion extends substantially parallel to said blades of said turbomolecular rotor and perpendicular to said cylinder.

As the mounting portion is perpendicular to the cylinder it forms a convenient surface for attachment of the attachment part of the drag rotor.

In some embodiments, said attachment part has a thermal conductivity of less than 50 W/mk, preferably less than 20 W/mK.

Providing an attachment part with a low thermal conductivity allows the turbomolecular rotor to be maintained at a significantly lower temperature than the drag rotor. This is important as the turbomolecular rotor operates at a particularly high vacuum so that removing heat from this portion of the pump is not easy. Thus, if the two portions of the rotor are to be maintained at significantly different temperatures thermal conductivity between the two must be kept low.

In some embodiments, said attachment part is thin and has a thickness of 3 mm or less.

In order to reduce the thermal conductivity between the drag rotor and the turbomolecular rotor, it may be advantageous if the attachment part is thin. In this regard, the attachment part must be relatively robust to enable the rotor to spin at a high speed and for the two portions to maintain rigidity. An attachment part with a thickness of less than 3 mm in some cases 2 mm or less has been found to have suitable strength and the required thermal conductivity, in particular when formed of a material such as steel or stainless steel.

In some embodiments there is a thermal break between the attachment part and the turbomolecular rotor at the point of attachment. This may be in the form of a ceramic washer In other embodiments there is no intermediate part and in some embodiments the attachment part is welded or braised to the turbomolecular rotor and there is no intermediate part between the turbomolecular rotor and the attachment part.

In some embodiments, said attachment part comprises a cylinder of a smaller diameter than said hollow cylindrical portion of said hub of said turbomolecular rotor such that there is a gap between said cylinder of said attachment part and said cylindrical portion of said hub.

In order to be physically robust and yet able to fit within the hub of the turbomolecular rotor, the attachment part may have a cylindrical form with a diameter that is smaller than the diameter of the turbomolecular rotor such that there is an air gap between them.

In this regard, the skirt of the drag rotor may have the same diameter as the cylinder of the attachment part or it may have a wider diameter there being a step between the two.

In some embodiments, said turbomolecular rotor comprises a high emissivity coating.

As mentioned previously, it may be difficult to remove heat from the turbomolecular stage of the pump owing to the high vacuum. It may be convenient to coat the rotor with a high emissivity coating to encourage radiation and thereby increase heat flow from the rotor.

In some embodiments, said turbomolecular stator comprises a high emissivity coating.

For similar reasons it may also be advantageous for the turbomolecular stator to have a high emissivity coating.

In some embodiments, said stator comprises a turbmolecular stage and a drag stage stator, said turbomolecular stage stator extending around said rotor and said drag stage stator being mounted within and thermally isolated from said turbomolecular stage stator.

As the drag stage of the pump may operate at a higher temperature than the turbomolecular stage, in order to reduce heat flow between the two it may be advantageous for the stator of the drag stage to be thermally isolated to some extent from the turbomolecular stage stator. In this regard, it may be mounted within it with a thermal break comprised of a thermally insulating material located between the two.

In some embodiments, said vacuum pump comprises a heater for heating said drag stage stator.

As the drag stage of the turbomolecular pump operates at a higher pressure there may be problems when pumping process gasses from processes such as semiconductor fabrication due to the condensation of particulates from these gasses at the higher pressures. Thus, it may be important to maintain the drag stage at a higher temperature than the turbomolecular stage of the pump and in order to do this the drag stage may in some embodiments have a heater associated with the stator. Where this is the case thermal insulation between the drag stator and the turbomolecular stator is important, as is some degree of thermal isolation between the drag stage rotor and the turbomolecular stage rotor.

In order for the process gases to be maintained at a temperature where process by-products do not condense then the heater may maintain the temperature of at least the portions of the stator and rotor that contact the process gases within the drag stage above 130° C. and preferably above 150° C. and in some embodiments between 160-180° C. These temperatures do not weaken the steel components and are sufficient to maintain the process gas by-products above their condensation temperatures at the pressure of operation of the drag pump.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which:

FIG. 1 schematically illustrates a vacuum pump according to an embodiment.

DETAILED DESCRIPTION

Before discussing the embodiments in any more detail, first an overview will be provided.

A vacuum pump is provided with a turbomolecular stage and a drag stage the rotor for which is formed in two parts. The drag stage rotor is attached to the turbomolecular stage rotor by an attachment part that extends upwardly from the drag stage skirt inside the turbomolecular stage rotor. The attachment part is configured to have a low thermal conductivity such that the drag stage can run at higher temperatures than the turbomolecular stage thereby impeding condensation of process gases. Heat flow from the hotter drag stage rotor to the turbomolecular rotor is constrained by the low thermal conductivity of the attachment part connecting the two. In order for the turbomolecular rotor not to heat up, any heat flow that does pass along the attachment part should be less than, or of an amount that can be dissipated from the turbomolecular rotor. In this regard owing to the high vacuum operation of this stage of the pump most of the heat dissipated from the turbo rotor is through radiation and is thus, quite small. A high emissivity coating to the turbo rotor may increase radiation heat loss. This coating may in some embodiments take the form of a black coating.

FIG. 1 shows a vacuum pump according to an embodiment. This vacuum pump comprises a turbomolecular stage 100, having an inlet end 102 and an outlet end 104, and a drag stage 106. The vacuum pump has a turbomolecular rotor 20 which is mounted by a drive spindle 22 within a motor and magnetic bearings 70. The magnetic bearings allow the rotor to rotate at high speeds with very low friction such that lubricants are not required. The main turbo rotor 20 comprises turbo pump blades 10 and a central cylindrical hub 12 from which the blades extend. A turbomolecular stator 80 has blades 108 corresponding to turbo pump blades 10. Turbomolecular stator 80 extends around the whole of the vacuum pump to form a part of the pump housing. Within this pump housing is the stator 40 of the drag stage 106 that is mounted to the turbomolecular stator 80 via thermal insulating members 50. Drag stage stator 40 is heated to maintain it at a temperature selected to be sufficient to inhibit condensation of the process gasses being pumped. Drag stage 106 has a stainless steel drag stage rotor 60 which in this embodiment is a Holweck drag stage rotor. Drag stage rotor 60 has a skirt 110 and a thin attachment part 30 extending from an upper surface of skirt 110. The thin attachment part 30 extends up into the cylindrical hub 12 of the turbomolecular rotor 20 and is attached to the under surface of a mounting portion 112 of turbomolecular rotor 20. In some cases, thin attachment part 30 is braised or welded to mounting portion 112, in other cases thin attachment part 30 is attached with some bolting means and there may be a thermal insulator between thin attachment part 30 and turbomolecular rotor 20.

The attachment piece 30 is in the form of a cylinder that has a smaller diameter than the inner diameter of the cylindrical hub 12 of the turbomolecular rotor 20. In this way there is an air gap 114 between cylindrical hub 12 and thin attachment part 30.

During operation the drag stage of the vacuum pump will operate at a higher temperature and pressure than the turbomolecular stage. As it operates at a higher pressure there is an increased likelihood of condensation of particles from process gasses being pumped. Maintaining the drag stage at a higher temperature reduces the chance of such condensates appearing. The use of a stainless steel rotor 60 that is more robust to higher temperatures allows this higher temperature operation while the attachment piece 30 having a significant length moving up into the turbomolecular rotor and being formed of a material with a low thermal conductivity, provides low thermal conduction between the higher temperature drag stage rotor and the lower temperature turbomolecular stage rotor allowing them to operate at different temperatures.

Conventionally the drag stage and turbomolecular stage have been formed as a single piece such that differences in temperatures between the two are difficult to maintain. Embodiments of the present invention form the rotor in two parts such that different materials can be used. Furthermore, although the two parts are attached together this is done in a way that despite the two parts of the rotor being adjacent to each other they are attached using a long attachment piece that extends within the turbo stage rotor. In this way, a certain degree of thermal isolation between the two stages of the rotor is provided allowing different temperatures of operation.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A vacuum pump comprising:

a turbomolecular stage, a drag stage, a stator and a rotor, wherein the rotor comprises a turbomolecular rotor, a single drag rotor and a spindle of a motor; wherein the turbomolecular rotor comprises a hub from which a plurality of blades extends, the hub comprising a mounting portion that is mounted to the spindle of the motor and a hollow cylindrical portion, the hollow cylindrical portion extending from the mounting portion towards an outlet end of the turbomolecular stage; and the drag stage comprises a single cylindrical skirt, and wherein an attachment part extends from the single cylindrical skirt, the attachment part extending within the hollow cylindrical portion of the hub of the turbomolecular rotor and being attached to a point that is closer to the mounting portion than to the outlet end of the turbomolecular stage, the single cylindrical skirt and the attachment part forming the single drag rotor, wherein every drag stage in the vacuum pump is formed in part by the single cylindrical skirt, and wherein, at the outlet end of the turbomolecular stage, the turbomolecular rotor is separated from the single cylindrical skirt by a gap.

2. The vacuum pump according to claim 1, wherein the single drag rotor is formed of a material that is more robust to higher temperatures than a material that is forming the turbomolecular rotor.

3. The vacuum pump according to claim 1, wherein the single drag rotor is formed of a material with a lower thermal conductivity than a material that is forming the turbomolecular rotor.

4. The vacuum pump according to claim 1, wherein the single drag rotor is formed of steel.

5. The vacuum pump according to claim 1, wherein the single drag rotor is formed of stainless steel.

6. The vacuum pump according to claim 1, wherein the turbomolecular rotor is formed of aluminum.

7. The vacuum pump according to claim 1, wherein the attachment part is attached to the mounting portion of the turbomolecular rotor.

8. The vacuum pump according to claim 1, wherein the mounting portion of the turbomolecular rotor extends parallel to the blades of the turbomolecular rotor and perpendicular to the spindle.

9. The vacuum pump according to claim 1, wherein the attachment part has a thermal conductivity of less than 50 W/mK.

10. The vacuum pump according to claim 1, wherein the attachment part has a thickness of 3 mm or less.

11. The vacuum pump according to claim 1, wherein the attachment part comprises a cylinder of a smaller diameter than the hollow cylindrical portion of the hub of the turbomolecular rotor such that there is a second gap between the cylinder of the attachment part and the hollow cylindrical portion of the hub.

12. The vacuum pump according to claim 1, wherein the turbomolecular rotor comprises a high emissivity coating.

13. The vacuum pump according to claim 1, wherein the stator comprises a turbomolecular stator comprising a high emissivity coating.

14. The vacuum pump according to claim 1, wherein the stator comprises a turbomolecular stage stator and a drag stage stator, the turbomolecular stage stator extending around the hub of the turbomolecular rotor, wherein the drag stage stator is mounted within the turbomolecular stage stator and thermally isolated from the turbomolecular stage stator.

15. The vacuum pump according to claim 14, wherein the vacuum pump comprises a heater for heating the drag stage stator.

* * * * *